United States Patent [19]

Waters

[11] 4,078,757

[45] Mar. 14, 1978

[54] SPEAKER STAND

[76] Inventor: Earl E. Waters, Rte. 2, Box 503, Goldsboro, N.C. 27530

[21] Appl. No.: 756,118

[22] Filed: Jan. 3, 1977

[51] Int. Cl.[2] ..... A47B 97/04

[52] U.S. Cl. ..... 248/441 R; 108/150; 248/158

[58] Field of Search ..... 248/441 R, 460, 158, 248/159; 108/150, 159, 157

[56] References Cited

U.S. PATENT DOCUMENTS

| | | | |
|---|---|---|---|
| 1,415,782 | 5/1922 | Brace | 108/150 |
| 1,674,823 | 6/1928 | Griffiths | 248/158 |
| 2,568,534 | 9/1951 | Baker | 108/150 |
| 3,313,513 | 4/1967 | Howell | 248/441 R |
| 3,934,806 | 1/1976 | Rady | 248/441 R |

FOREIGN PATENT DOCUMENTS

| | | | |
|---|---|---|---|
| 987,918 | 3/1965 | United Kingdom | 248/159 |

*Primary Examiner*—Roy D. Frazier
*Assistant Examiner*—William E. Lyddane

[57] ABSTRACT

A plurality of parts are so designed and fabricated from a lightweight, moldable material, such as plastic, that when assembled form an integral, sturdy speaker stand combining the features of economy, durability, and ease of handling.

3 Claims, 5 Drawing Figures

SPEAKER STAND

BACKGROUND OF THE INVENTION

For years, speaker stands or "lecturns" have been constructed of metal or wood. As such, they are relatively expensive, heavy and cumbersome. Any previous attempts at constructing a speaker stand from plastic or other lightweight, moldable materials have not been successful because of their relative "flimsiness", and also because of their tendency to be top heavy.

SUMMARY OF THE INVENTION

The present invention, then, is directed to a speaker stand formed of a lightweight, moldable material such as plastic in which the individual parts are so designed, fabricated, and assembled, that the resulting structure is sturdy and resists the tendency to wobble or become loose. Further, because of the use of lightweight, moldable materials, the economies of production are so much improved that the lecturn according to the present invention realizes a superior market position.

In general, the speaker stand according to the present invention includes a base member having a substantial flat bottom surface with a cylindrical mounting hub having an axial opening therein extending upwardly from the central portion thereof, an upper support member having a substantially flat, but tilted, upper surface lying in a plane inclined with respect to the horizontal and a second cylindrical mounting hub having an axial opening extending downwardly from the central portion of the upper support member, and an elongated upright, tubular shaft member connecting the upper and lower support members and having an outer diameter substantially equal to and no greater than the axial opening in the first and second mounting hubs. The base member, upper support member, and tubular shaft member are all formed of a relatively lightweight, moldable material and the parts are bonded together to form an integral unit which is sturdy, but extremely lightweight.

It is therefore an object of the present invention to provide a speaker stand formed integrally of an extremely lightweight, moldable material.

It is another object of the present invention to provide a speaker stand of the type described in which the individual components are so molded or fabricated, that when assembled, the speaker stand takes on the appearance of an integrally molded unit and is substantially as sturdy.

Other objects and a fuller understanding of the invention will become apparent from reading the following detailed description of a preferred embodiment in view of the accompanying drawings in which.

DETAILED DESCRIPTION OF THE PREFERRED EMBODIMENT

Figure 1:
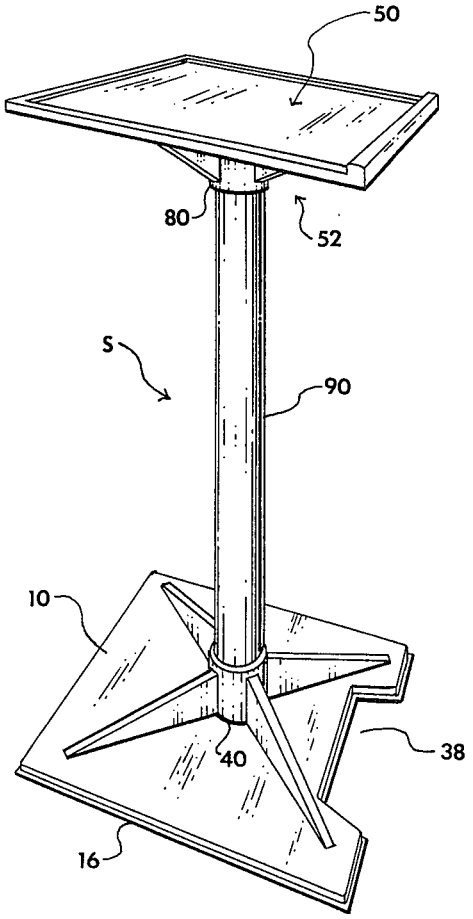
FIG. 1 is a perspective view of the speaker stand according to the present invention.
Figure 2:
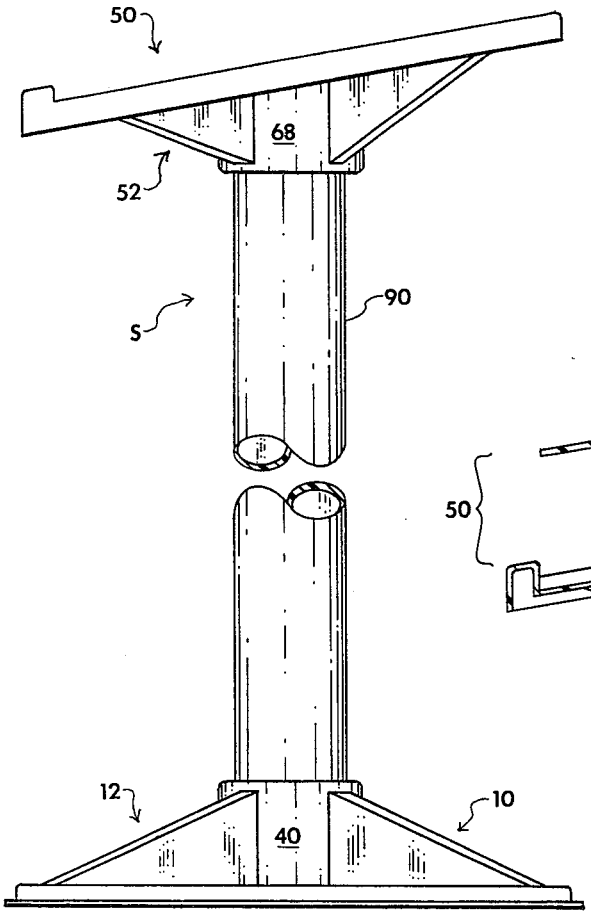
FIG. 2 is an enlarged, longitudinal sectional view, with parts broken away, of the speaker stand illustrated in FIG. 1.
Figure 3:
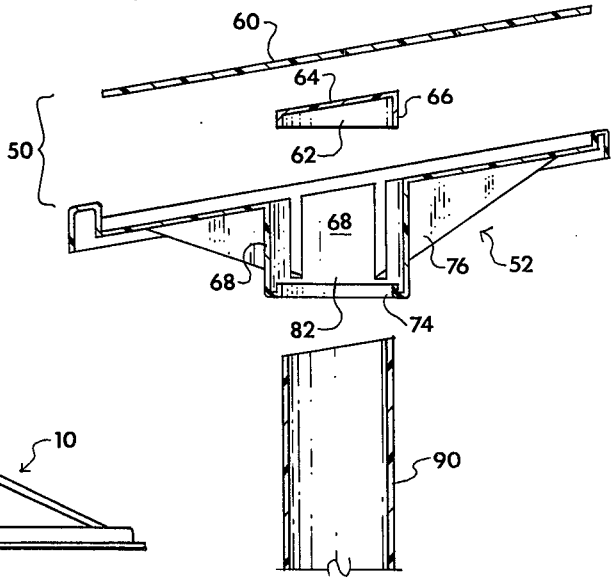
FIG. 3 is an exploded side view of the speaker stand illustrated in FIGS. 1 and 2.
Figure 3:
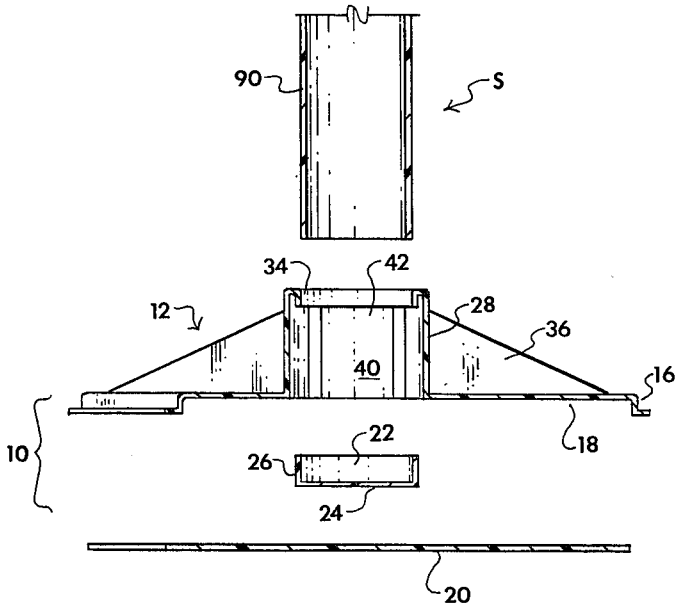
Figure 4:
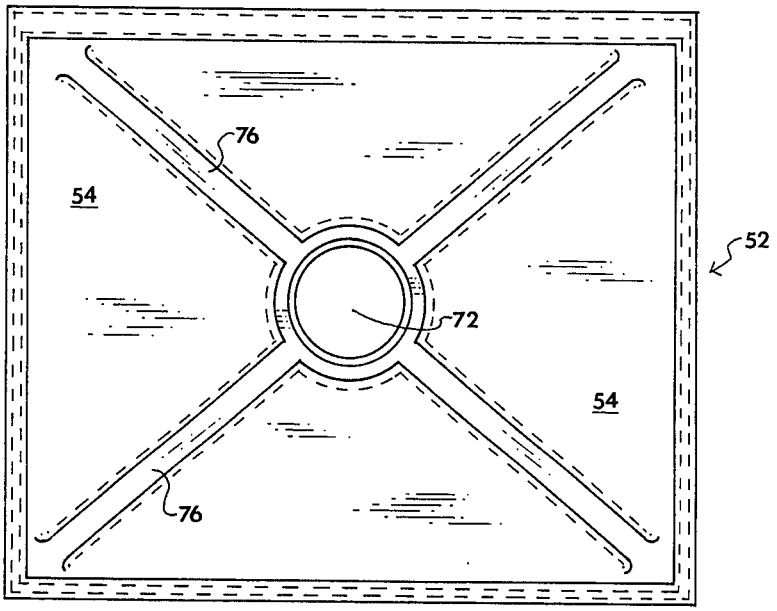
FIG. 4 is a plan view of the upper support member superstructure with the top plate removed.

Turning now to the drawings, and particularly to FIGS. 1–3, there is illustrated the lecturn S according to the present invention which, in general, includes a base member 10 with a substantially flat bottom 30 and a first cylindrical mounting hub 40, having an axial opening 42 therein, extending upwardly from the central portion of the base member 10; an upper support member 50 having a substantially flat, but tilted, upper surface 70 lying in a plane inclined with respect to the horizontal, and a second cylindrical mounting hub 80, having an axial opening 82 therein, extending downwardly from the central portion of the upper support member; and an elongated, upright, tubular shaft member 90 having an outer diameter substantially equal to and no greater than the axial openings 42, 82 in the aforementioned mounting hubs 40, 80, which tubular shaft member 90 connects the base member 10 with the upper support member 50. The aforementioned base member 10, upper support member 50 and tubular shaft 90 are formed of a relatively lightweight, moldable material and are bonded together to form an integral unit.

Figure 5:
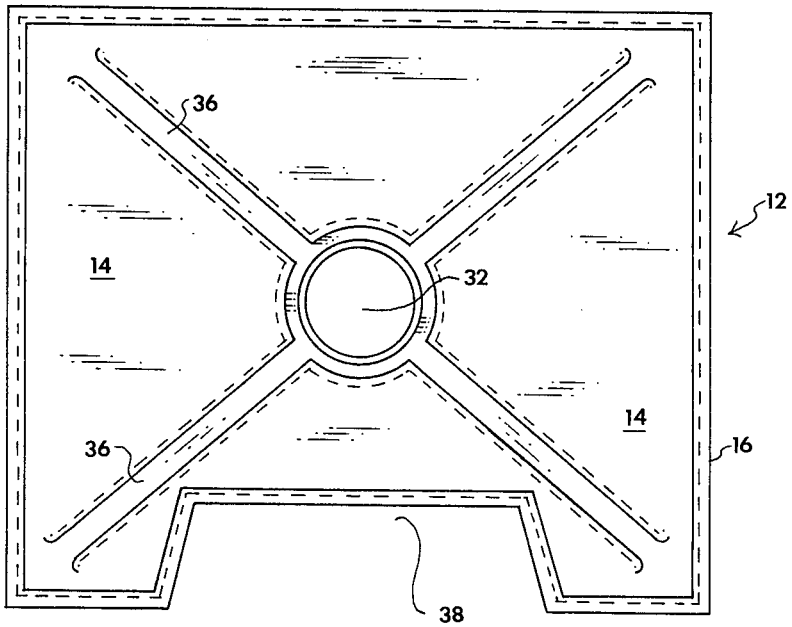
FIG. 5 is a plan view of the base member superstructure with the bottom plate removed, and looking upwardly from the bottom thereof.

More particularly, base member 10 in reality is formed of three separate members. The first is a molded base superstructure 12 (FIG. 5) having a generally rectangular, flat, horizontally disposed major surface 14 with a flange 16 extending downwardly, then outwardly therefrom around the peripheral edge thereof forming a shallow chamber 18 which subsequently receives a flat rectangular plate 20 therein, thereby forming the flat bottom surface 30. An inverted cup-shaped member 22 having a circular disc portion 24 with an upstanding flange 26 extending around the periphery thereof is secured to plate 20 to form a receiving cap for shaft 90 in the assembled position. The inner diameter of the flange 26 is substantially the same as the outer diameter of shaft 90 or slightly greater, so that the shaft is easily fit therein, and may be bonded thereto by a chemical bonding agent, such as butyl acetate or menthol ethyl ketone.

Meanwhile, hub 40 is formed by a cylindrical wall 28 which extends upwardly from a relatively large opening 32 in the central area of major surface 14. Cylindrical wall 28 terminates in a down turn lip 34 having an inner diameter substantially the same as the diameter of shaft 90, or slightly greater. A plurality of wedge-shaped gussets 36 are molded into the superstructure 12 between the flat major surface 14 and the wall 28 to lend support and rigidity to the base member 10. One of the edges of major portion 14 includes a cutout 38 therein which is vertically aligned with the lowermost side of upper support 12 to provide clearance for the speaker's feet.

Turning now to the upper support member 50, as illustrated in FIGS. 1–4, a molded superstructure 52 (FIG. 4) includes a generally rectangular, flat, major surface 54, so molded as to define an inclined plane with respect to the horizontal, and a raised peripheral lip 56, preferably higher at the bottom, extending upwardly from the peripheral edges of the aforementioned major surface 54 for subsequently receiving a flat rectangular plate 60 of a length and width such as to fit snugly atop the major surface 54 inside the boundary defined by the aforementioned peripheral lip 56. A shaft cap 62 in the shape of a circular disc 64 with a downwardly depending flange 66 therefrom is secured to the undersurface of flat plate 60 to form a receiving recess for the upper end of shaft 90. As is the case with cap 22, the flange 66 is of an inner diameter substantially the same as the outer diameter of shaft 90, or slightly greater. Further, it should be noted that the disc portion 64 of cap 62 is inclined with respect to the flange 66, so that, when assembled, the disc portion 64 becomes coplanar with the major surface 54. A cylindrical wall 68 extends downwardly from a relatively large opening 72 in major surface 54 and terminates in an upwardly extending lip 74 to define the second mounting hub with its axial opening 82 therein of substantially the same or slightly greater diameter than shaft 90. Reinforcing gussets 74 extend between the central surface 54 and the cylindrical wall 68 in a similar manner to that illustrated and described in connection with the base member 10.

In assembling the entire structure as illustrated in FIGS. 1–3, the upper plate 60 is assembled onto the superstructure 52 and secured thereto by a suitable bonding agent such as the butyl acetate with the receiving cap 62 extending downwardly through the central opening 72. The upper end of shaft 90 extends through the axial opening 84 into communication with the cap 62, and is similarly secured thereto. The base member 10 is assembled in the same manner with the lower plate 20 secured to the base superstructure 12 and the lower end of shaft 90 being received within the lower cap member 22 and secured thereto. So arranged, the assembled structure appears as an integral unit with considerable strength and rigidity, yet is very lightweight. While having the appearance of a one-piece molded unit, it is in reality a combination of individually fabricated parts, which can each be formed economically and assembled in a short time. The completed unit combines the features of minimizing costs and weight, while maximizing strength and rigidity.

While a preferred embodiment of the invention has been shown and described, it is obvious that various changes and slight modifications might be made without departing from the scope and intent of the present invention which is set forth in the following claims.

What is claimed is:

1. A speaker stand comprising:

(a) a base member having a substantially flat bottom surface and a first cylindrical mounting hub having an axial opening therein extending upwardly from the central portion of said base member;

(b) an upper support member including a molded superstructure having a generally rectangular, flat, major upper surface lying in a plane inclined with respect to the horizontal, a raised peripheral lip extending upwardly from the peripheral edges of said major surface, and a second cylindrical mounting hub in the form of a tubular wall extending downwardly from the edge of a circular central opening in said major upper surface terminating in an inwardly and upwardly turned flange which defines an axial opening therein, a flat plate of a length and width such as to fit snugly atop said major surface inside the boundary defined by said peripheral lip and secured to said major surface to form a support surface for articles placed on said speaker stand;

(c) an elongated, upright, tubular shaft member having an outer diameter substantially equal to and no greater than the axial opening in said first and second mounting hubs;

(d) a shaft cap including a circular disc lying co-planar, but unattached to said major surface of the molded superstructure of said upper support member and of a diameter less than said central opening therein, said circular disc including a downwardly turned peripheral flange having an inner diameter substantially the same as the outer diameter of said shaft member for receiving the upper end of said tubular shaft; and (e) said base member, tubular shaft, and upper support member being formed of a relatively lightweight, moldable material and bonded together with said tubular shaft joining and extending between said base member and said upper support member to form an integral unit.

2. The speaker stand according to claim 1 and further including a plurality of reinforcing gussets molded into said superstructure and extending between said major surface and said tubular wall.

3. A speaker standing comprising:

(a) a base member having a substantially flat bottom surface, formed of a molded superstructure including a generally flat, major surface, a depending peripheral lip extending downwardly from the peripheral edge of said major surface, and first cylindrical mounting hub having an axial opening therein extending upwardly from the central portion of said base member and formed by a tubular wall extending upwardly from the edge of a circular central opening in said major surface terminating in an inwardly and downwardly turned flange which defines said axial opening, a flat plate of a length and width such as to fit snugly beneath said major surface inside the boundary defined by said peripheral lip and secured to said major surface to form said flat bottom surface;

(b) a lower shaft cap including a circular disc lying co-planar but unattached, to said major surface, and of a diameter less than said central opening of said major surface, said circular disc including an upwardly turned peripheral flange having an inner diameter substantially the same as the outer diameter of said shaft for receiving the lower end of said tubular shaft;

(c) an upper support member having a substantially flat upper surface lying in a plane inclined with respect to the horizontal, and a second cylindrical mounting hub having an axial opening therein extending downwardly from the central portion of the upper support member;

(d) an elongated, upright, tubular shaft member having an outer diameter substantially equal to and no greater than the axial opening in each of said first and second mounting hubs;

(e) said base member, tubular shaft, and upper support member being formed of a relatively lightweight, moldable material and bonded together with said tubular shaft joining and extending between said base member and said upper support member to form an integral unit.

* * * * *